United States Patent [19]

Hill

[11] Patent Number: 4,671,775

[45] Date of Patent: Jun. 9, 1987

[54] SURVIVAL HOOD

[76] Inventor: Patrick S. Hill, c/o Bristol Uniforms Ltd., Wathen Street, Staple Hill, Bristol BS16 5LL, United Kingdom

[21] Appl. No.: 803,409

[22] PCT Filed: Mar. 19, 1985

[86] PCT No.: PCT/GB85/00105

§ 371 Date: Nov. 19, 1985

§ 102(e) Date: Nov. 19, 1985

[87] PCT Pub. No.: WO85/04145

PCT Pub. Date: Sep. 26, 1985

[30] Foreign Application Priority Data

Mar. 21, 1984 [GB] United Kingdom ..... 8407372

[51] Int. Cl.[4] ..... B63C 9/08

[52] U.S. Cl. ..... 441/124; 2/202

[58] Field of Search ..... 441/102–105, 441/123, 124, 136; 405/186; 2/171, 173, 202, 205, 209.1, 247

[56] References Cited

U.S. PATENT DOCUMENTS

| | | | |
|---|---|---|---|
| 1,201,556 | 10/1916 | Chlumsky | 441/105 |
| 1,878,434 | 9/1932 | Belloni | 441/105 |
| 1,901,859 | 3/1933 | Anderson | 441/105 |
| 2,113,779 | 4/1938 | Williamson | 441/105 |
| 2,800,901 | 7/1957 | Monro | 2/202 |
| 2,835,899 | 5/1958 | Monro et al. | 2/202 |
| 2,870,451 | 1/1959 | Brodsky | 2/202 |
| 3,014,221 | 12/1961 | Brunetto | 2/205 |
| 3,107,373 | 10/1963 | Mellon et al. | 441/105 |
| 3,246,350 | 4/1966 | Pollmann | 441/105 |

*Primary Examiner*—Joseph F. Peters, Jr.
*Assistant Examiner*—Stephen P. Avila

[57] ABSTRACT

A survival hood particularly for use with buoyancy garments in water to act as a splash guard comprises a hood-like cover (1) with a lower neck opening and adapted to fit over and envelope a wearer's head and face. The face portion of the hood (1) comprises a window (5) of crumplable transparent waterproof material and presents a spray-free fitting to a wearer's face. A pair of ventilating apertures (6) are provided in the region of a wearer's temples. A lower extension of the hood (1) comprises a rear elasticated neck portion (4) and a forward bodice portion (3) arranged to extend over a wearer's chest and to be releasably secured by straps (11) to a buoyancy garment. A lower flap-like extension (7) of the bodice (3) provided with quick-release fasteners (8,9) is arranged to wrap around the hood (1-5) when folded and rolled to form a bundle-like package.

6 Claims, 4 Drawing Figures

SURVIVAL HOOD

This invention relates to survival hoods and particularly to such hoods for attachment to and use with life jackets or other buoyancy garments or suit in water to act as a splash guard.

Although a person in water or in a water situation and wearing a life jacket may be at risk of dying from hypothermia, there is also the risk of drowning due to imbibing water from spray and waves.

It is an object to provide a survival hood to act as a splash guard and minimise the risk of inadvertently imbibing water from spray or waves when worn by a person floating head upwards in water, which is of lightweight, small and easily packaged and capable of being attached to any life jacket buoyancy suit or protective garment having inherent buoyancy.

It has previously been proposed in the Royal Navy to utilise a splash guard in connection with the Mark III General Service Lifejacket which comprises a generally rectangular piece of butyl material secured along one side to the back of the stole of the jacket to form a flap. A middle portion of the flap is of clear transparent plastic and two holes are provided at either side of a top portion for ventilation. Normally the flap is stowed rolled up and releasably secured to the back of the jacket. For use it is unfurled and secured to the front of the life jacket buoyancy chamber.

It is an object of the invention to provide an improved survival hood.

According to the invention a survival hood comprises a hood-like cover with a lower neck opening adapted to fit over and envelope the head and face of a wearer and formed at least over an eye portion with a window of transparent material for sight purposes, the hood having a face portion adapted to present a spray-free fitting to the face, and at least one ventilating aperture arranged for the passage of air to and from a zone behind the face portion to allow for breathing of the wearer.

The hood is suitably formed of lightweight, pliable water-resistant fabric and the window is suitably of thin clear plastics material which will crumple generally as fabric but will not conform closely to the contours of the face thereby ensuring air passageways from the face area to the ventilating aperture.

Suitably the hood is arranged to envelope and extend below the head and at the rear is formed with a neck engaging portion. At the front the hood is suitably extended downwardly as a bodice portion adapted to extend over and engage the chest portion of the life jacket or buoyancy garmet of the wearer and provided with securing fasteners. The fasteners are preferably of a kind for releasable fitting to a life jacket.

The neck portion and bodice portion are suitably so formed to conform to the shoulder and chest of the wearer to inhibit free passage of surface water upwardly into the hood, and at a rear region the neck portion is suitably elasticated to obtain a fitting relationship between the rear region of the hood about the neck of a wearer.

In an embodiment the window of crumplable plastics material extends substantially completely over the face area of the mask to allow unimpeded vision to the wearer, and two vent apertures are provided at locations generally corresponding to the temples of the wearer.

The bodice portion of the mask is suitably provided with a flap-like downward extension, the hood being foldable into a roll shaped bundle about which the flap-like extension may be wrapped to present a portable package. The flap-like extension is suitably provided with complementary press-stud or other quick-release fasteners arranged adjacent a lower end of the bodice and at a free end of the flap to secure it in readily releasable manner about the rolled hood.

The hood is suitably provided with a pair of attachment straps secured to a lower portion of the bodice at opposite sides for securing the hood to the wearer's chest, and particularly to the front of a buoyancy garment. To this end the straps are suitably provided with quick-release fasteners.

The invention also includes a hood of the inventive kind attached or releasably secured to a life jacket or other buoyancy garment such that the hood may be worn with the life jacket or garment by a person in proper manner.

Suitably, the hood is readily releasable from the life jacket and preferably the means securing the hood are also adjustable so that the fit of the hood can be adapted to different sized people in relation to the jacket.

An embodiment of the invention will now be described by way of example with reference to the accompanying partly diagrammatic drawings, in which.

Figure 1:
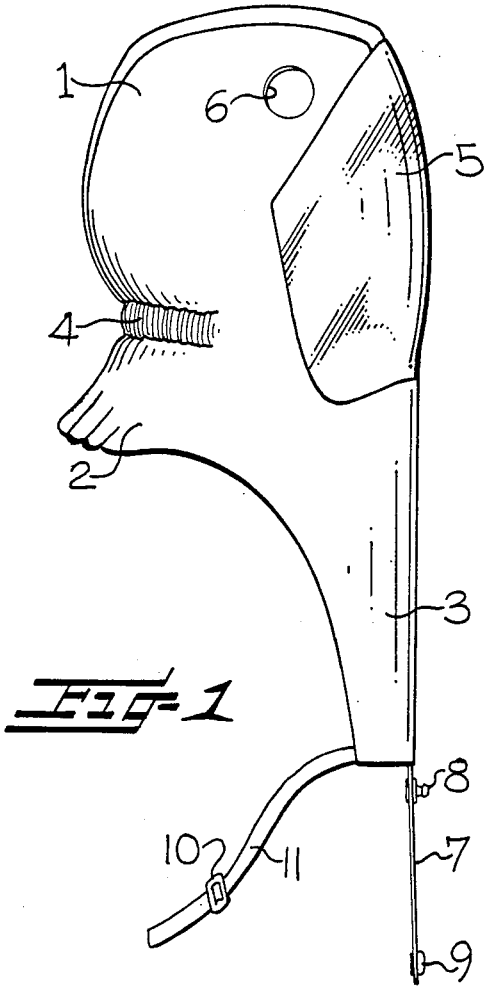
FIG. 1 is a side elevation of a hood according to the invention.
Figure 2:
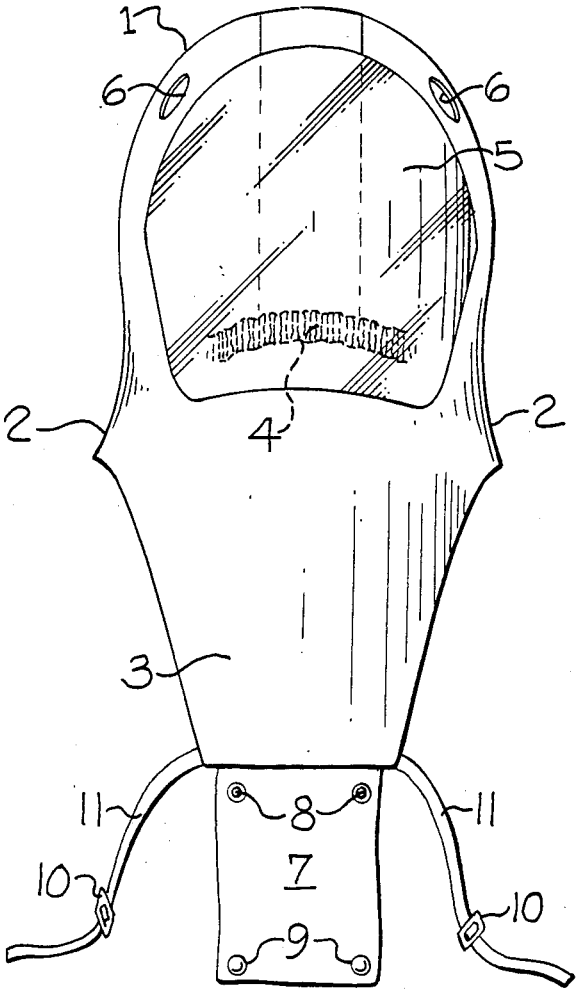
FIG. 2 is a front elevation of the hood of FIG. 1 from the right-hand side of that figure.

The survival hood of FIGS. 1 and 2 comprises a cover portion 1 suitably of a plastics or plasticised water-resistant fabric, adapted to fit over the head of a person to cover the face and complete head, and extending downwardly at the rear and sides as a flared shoulder fitting portion 2 and at the front as a bodice portion 3.

At the rear a neck portion 4 is drawn in by an elasticated section arranged to extend about a rear neck portion of the wearer, and disposed between the cover portion 1 and the shoulder fitting portion 2. The face of the cover portion is formed with a transparent window 5 of flexible or crumplable plastics material. The window 5 is extended over an area corresponding to the face of the wearer, suitably from the forehead to below the chin, and sidewardly towards the ears of the wearer, so as to provide substantially unrestricted vision to the wearer. The upper side of the window 5 is suitably curved in upwardly convex manner so that material of the cover 1 outside the window 5 is arranged to extend over the temple zones of the wearer, at which the cover is formed with apertures 6, one on each side.

The bodice portion 3 extends downwardly as a chest covering portion and at a lower portion is provided with a pair of fastening straps 11 one at each side, secured at one end to the bodice portion 3 at their free ends having buckles 10 or other releasable fastener such as snap shackles, for releasably securing the straps 11 to straps of a life jacket. Between the straps 11 the bodice portion is provided with a depending packaging flap 7 of rectangular form and having a pair of upper press-stud fittings 8 and a pair of lower complementary press-stud fittings 9.

Figure 3:
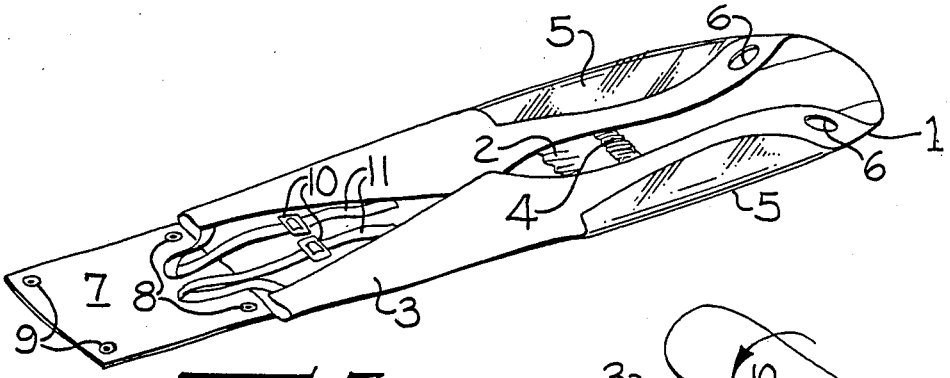
FIG. 3 is a perspective view of the hood of FIGS. 1 and 2 in a partially packed condition.
Figure 4:
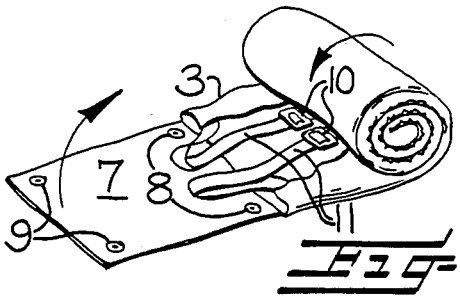
FIG. 4 is a side elevation of the partially packaged hood of FIG. 3 in a rolled condition prior to fastening a flap.

As shown in FIG. 3 the hood can be layed face downwards and the hood folded to define a folded strip 10 conforming to the width of the flap 7. The folded strip 12, from an end remote from the flap 7 can then be rolled up, as shown in FIG. 4, and the flap 7 can then be folded about the roll 12 as indicated by the broken arrow, to embrace the roll 13 and engage the press studs 9 with the complementary studs 8 to secure the hood in a convenient unitary package without the need for a separate bag. If desired the straps 11 may be exposed from the rolled package at opposite ends so that the package may be secured to a life jacket so as to be available in appropriate position for use in an emergency or separately stored until required for use. The rolled package is small e.g. 25 cm by 5 cm diameter and light in weight e.g. 120 grammes.

In use, the package is opened by releasing the studes 8, 9 and the hood unrolled and opened out for the entry of the head of a wearer. The straps 11 serve to hold the hood on the head and are adjustable by means of the buckles 10 to draw the hood downwardly on the wearer's head and engage the bodice portion 3 and the shoulder fitting portion 2 with the wearer's body. This restricts free entry of spray and surface water upwardly into the hood. However due to the crumplable nature of the fabric of the hood there is no restraint of free draining of water from the hood.

The hood will generally conform to the skull and face of the wearer, but due to the crumplable nature of the window 5 air passages will remain between the nostrils and mouth of the wearer and the apertures 6 for breathing and ventilation purposes. The tension of the straps 11 will tend to keep the window 5 away from the mouth and nostrils of the wearer.

The hood serves in use to protect the wearer against spray and surface water when supported by a life jacket and reduces the risk of imbibing water. By virtue of its compact packaging ability it is readily portable and can be secured to a life jacket when required or maintained on a jacket at all times ready for use in emergency.

The invention includes a life jacket or other buoyancy garment provided with a survival hood according to the invention, and to such a combination in which the survival hood is releasably secured in position.

I claim:

1. A survival hood characterised by a hood-like cover comprising a head portion with a lower neck opening and adapted to fit over and envelope the head and face of a wearer, the hood having a face portion formed at least over an eye portion with a window of transparent material for sight purposes, the face portion being adapted to present a spray-free fitting to the face, and two ventilating apertures positioned at locations generally corresponding to the temples of a wearer for the passage of air to and from a zone behind the face portion to allow for breathing of the wearer the window being of thin clear crumplable waterproof material and the hood being otherwise essentially formed of lightweight pliable and crumplable water-resistant fabric, the hood having an extension below the head portion, the extension comprising a rear neck engaging portion and a forward bodice portion adapted to extend over a chest portion of the wearer for releasable securement thereto, the hood bodice portion being provided at a lower portion with fastening straps for releasable securement to the wearer.

2. A hood as claimed in claim 1, characterised in that the straps are provided with quick-release fasteners.

3. A hood as claimed in claim 1, characterised in that the window extends substantially completely over the face portion.

4. A hood as claimed in claim 1, characterised in that the rear neck engaging portion is elasticated.

5. A hood as claimed in claim 1, characterised in that the bodice portion is provided with a flap-like downwardly extension, the hood and window being foldable into a roll-shaped bundle about which the flap-like extension may be wrapped and secured to present a portable package.

6. A hood as claimed in claim 5, characterised in that the flap-like extension is provided with complementary quick-release fasteners arranged to secure the flap-like extension in readily releasable manner about the rolled hood (13).

* * * * *